US005265680A

United States Patent [19]

Withers et al.

[11] Patent Number: 5,265,680

[45] Date of Patent: Nov. 30, 1993

[54] METHOD FOR INSTALLING INSTRUMENTS IN WELLS

[75] Inventors: Robert J. Withers; Harrison F. Blacker, both of Plano, Tex.

[73] Assignee: Atlantic Richfield Company, Los Angeles, Calif.

[21] Appl. No.: 959,971

[22] Filed: Oct. 9, 1992

[51] Int. Cl.[5] ..... E21B 17/14; E21B 33/14; E21B 47/00

[52] U.S. Cl. ..... 166/380; 166/65.1; 166/242; 166/381

[58] Field of Search ..... 166/380, 381, 242, 385, 166/65.1, 66, 250, 253

[56] References Cited

U.S. PATENT DOCUMENTS

| | | | |
|---|---|---|---|
| 3,807,499 | 4/1974 | Tausch et al. | 166/242 |
| 4,506,729 | 3/1985 | Davis, Jr. et al. | 166/242 X |
| 4,603,578 | 8/1986 | Stolz | 166/242 X |
| 4,616,702 | 10/1986 | Hanson et al. | 166/242 X |
| 4,664,192 | 5/1987 | Hogarth | 166/291 |
| 4,676,310 | 6/1987 | Scherbatskoy et al. | 166/65.1 |

*Primary Examiner*—Stephen J. Novosad
*Attorney, Agent, or Firm*—Albert C. Metrailer

[57] ABSTRACT

A method for installing an instrument at or near the bottom of a cased well. A cavity is formed within the body of a float shoe or float collar positioned at the bottom or near the bottom of a casing string as it is assembled for installation in a well. An instrument is positioned within the cavity and an appropriate electrical cable is run from the instrument along the outer side of the casing string to the earth surface. The float shoe or float collar provides mechanical protection for the instrument during the installation of the casing string in the wellbore and during the cementing operation and ensures good acoustic coupling of the geophones to the earth in the downhole applications.

6 Claims, 1 Drawing Sheet

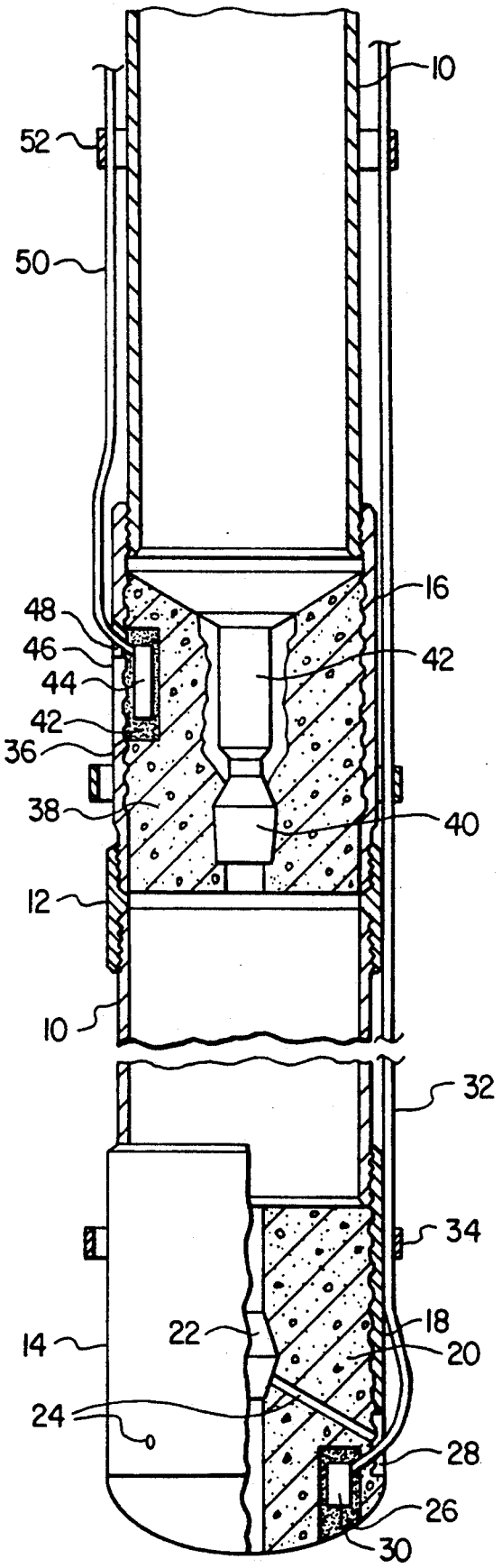
10
52
50
16
48
46
42
44
42
36
38
40
12
10
32
34
18
14
22
20
24
28
26
30

METHOD FOR INSTALLING INSTRUMENTS IN WELLS

BACKGROUND OF THE INVENTION

The present invention relates to wells, either production or injection, having instruments permanently installed near the bottom thereof, and methods for installing such instruments.

It is often desirable to install instruments such as geophones or pressure or temperature sensors at the bottom of wells. A geophone located at the bottom of a well may be used for receiving signals in a vertical seismic profiling process or a tomographic imaging process Pressure or temperature sensors may be used to monitor conditions at the bottom of the well, typically in the producing or injection zone for long term control and maintenance purposes.

In the past, instruments have been simply inserted within the well casing on an appropriate cable for such purposes. However, such installations are subject to damage when other devices such as tubing or pumps are inserted into the same well casing. In the case of steam injection wells, the devices and electrical cable would be exposed to the injected steam typically at a temperature of 500° F. Thus, installation of such devices within the casing exposes them to mechanical, chemical, and thermal damage.

To avoid the conditions within the well casing, instruments and the electrical cables required to connect them to the earth's surface have been attached to the outer surface of a well casing before insertion into the wellbore. While the armored cable used for these purposes can be strapped tightly to the well casing, and usually survives insertion of the well casing into the borehole, the instruments themselves are far more likely to be damaged or destroyed during the installation process. The instruments are of larger diameter than the cable and thus tend to be mechanically damaged as the casing is lowered down the borehole or when cement is pumped into the annulus between the casing and the borehole

SUMMARY OF THE INVENTION

The present invention provides a method for installing instruments at the bottom of cased wellbores which provides mechanical protection for the instrument during the installation process. In one embodiment, a cavity is formed within the body of a float shoe attached to the lower end of a casing string and the instrument is mounted within the cavity so as to be protected during the installation process. In an alternate embodiment, a similar cavity is formed within the body of a float collar forming part of the lower end of the casing string and therefore located near the bottom of the completed case well. In either case, armored cable is connected to the instrument and strapped to the outer surface of the casing to provide electrical connection to the earth's surface.

DESCRIPTION OF THE DRAWINGS

The present invention may be better understood by reading the following detailed description of the preferred embodiments, with reference to the accompanying drawing, which is a cross sectional view of the lower end of a casing string, having both a float shoe and a float collar which have been adapted for use in the present invention.

DESCRIPTION OF THE PREFERRED EMBODIMENTS

With reference to the FIGURE, there is provided a cross sectional view of the lower end of a casing string prepared for installation in an open borehole. As illustrated, a typical casing string is made up of a series of casing sections 10 connected together by collars 12. At the lower end of the casing string, there is normally provided a float shoe 14 which prevents damage to the lower end of the casing string during the installation process and facilitates cementing of the casing into the wellbore. A float collar 16 is also typically provided at the upper end of the lowermost casing section 10, also for the purpose of aiding in the cementing process.

Float shoe 14 includes an outer metal casing 18 which is threaded for attachment to a casing section. The main body portion 20 of float shoe 14 is made of high strength concrete, similar to Portland cement mixed with stone aggregate and similar to the cementing material used to cement the casing within the wellbore Cast within body 20 is a valve 22 and various flow passages 24 through which the cement is pumped into the annulus between the casing and the wellbore.

In the instrument installation process of the present invention, the float shoe 14 is modified to provide a protective housing for an instrument such as a geophone In particular, an appropriate sized cavity 26 is formed within the cement body 20 of float shoe 14. In addition, a slot 28 is cut into the outer wall 18 of float shoe 14 in communication with cavity 26. The dimensions of cavity 26 should be slightly larger than the selected instrument and the width of slot 28 should be slightly wider than required for an armored cable.

A geophone 30 is shown positioned within cavity 26. The geophone is typically bonded within the cavity by an appropriate cement, such as an epoxy resin, which would fill all empty spaces and provide a solid bond between the instrument and the body of float shoe 14. The instrument 30 is connected to surface equipment by means of an electrical cable 32 positioned within slot 28 and attached to the outer surface of the casing string by straps 34 in a conventional manner. Cable 32 is typically a multiconductor electrical cable protected by a stainless steel armored sheath.

Cavity 26 is preferably formed within the body 20 of float shoe 14 at the time the float shoe is manufactured. That is, it can be cast at the same time that the valve 22 and float channels 24 are formed. However, the cavity may also be cut into the float shoe 14 after it is delivered to the well site if desired. A geophone suitable for a high temperature injection well is sold under the name Sensor SM-500 by Halliburton Geophysical Services, Inc. This geophone has an outer diameter of about 1 inch and a height of about 1.5 inches. Cavity 26 would therefore need to have slightly larger dimensions. For certain types of geophysical work, three component geophones are preferred. Such geophones actually comprise a housing having three single components geophones positioned in three directions. A typical housing has an outer diameter of 1.77 inches and an overall length of 7.28 inches Most float shoes 14 provide sufficient space within body 20 to form a cavity which will hold and protect such a three component geophone while still leaving sufficient space for ports 24.

As an alternative to an instrument positioned in float shoe 14, an instrument may be installed within float collar 16. Float collar 16 includes an outer metal casing section 36 and a body portion 38 formed of concrete A valve 40 and an adaptor 42 for connection to a tubing string are cast within the body 38.

According to the present invention, the standard float shoe 16 is modified to provide a cavity 42 within the body 38 thereof for housing an instrument 44. This is done by first cutting out a section 46 of the metal casing portion 36. Then a portion of the body 38 is machined out to an appropriate size and shape according to the instrument 44 which has been selected. An appropriate slot 48 is cut in the upper portion of the section 46 of casing 36 to provide a path for an electrical cable 50. The instrument 44 is then firmly bonded into cavity 42, for example with an epoxy resin, and the cable 50 positioned adjacent to the casing string and attached with straps 52. The previously removed section 46 of the outer casing is then repositioned and spot welded back onto float collar 16.

If instruments are placed in both the float shoe 18 and the float collar 16, it would be preferred that they be aligned on the same side of the casing string so that the cables 32 and 50 would be positioned together along the casing string. In the FIGURE, they have been illustrated on opposite sides of the casing string for illustrations purposes only. It is desirable that the electrical cables, such as 32 and 50, be attached along a known side of the casing along its entire length or at least over the length in which the casing may be perforated In this way the perforation guns can be oriented so as to not damage the cables The installation of instruments 30 and 44 will normally be made at the well site as the casing string is being made up. Once the tubing string is in place in the well and cemented, the instruments will be permanently installed and should be safely protected. In the case of geophones, the cementing operation bonds the casing string, and therefore the geophones, to the surrounding formation The geophones therefore will respond well to acoustic signals passing through the formation.

While the present invention has been described in terms of specific apparatus and methods of use, it is apparent that modifications may be made therein within the scope of the appended claims.

What is claimed is:

1. A method for installing an instrument at the bottom of a cased wellbore, comprising:

providing a cavity in the body of a float shoe, said float shoe connected to the lower end of a casing string;

mounting an instrument within said cavity;

electrically connecting an electrical cable to said instrument and mechanically attaching said cable to the outer surface of the casing string from said float shoe to the upper end of said casing string;

installing said casing string in said wellbore.

2. A method according to claim 1, wherein the body of said float shoe is formed of cement.

3. A method according to claim 1, wherein the instrument is a geophone.

4. A method for installing an instrument near the bottom of a cased wellbore, comprising:

providing a cavity in the body of a float collar, said float collar connected between casing sections near the lower end of a casing string;

inserting an instrument within said cavity;

electrically connecting an electrical cable to said instrument and mechanically attaching said cable to the outer surface of the casing string from said float collar to the upper end of said casing string;

installing said casing string in said wellbore.

5. A method according to claim 4, wherein the body of said float collar is formed of cement.

6. A method according to claim 4, wherein the instrument is a geophone.

* * * * *